US007789253B2

(12) United States Patent
Sawai et al.

(10) Patent No.: US 7,789,253 B2
(45) Date of Patent: Sep. 7, 2010

(54) COMBINATION CRANE

(75) Inventors: Hirotsugu Sawai, Akashi (JP); Mamoru Uejima, Akashi (JP); Satoshi Mimura, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 24 days.

(21) Appl. No.: 12/132,230

(22) Filed: Jun. 3, 2008

(65) Prior Publication Data

US 2008/0302749 A1 Dec. 11, 2008

(30) Foreign Application Priority Data

Jun. 8, 2007 (JP) ..... 2007-152776

(51) Int. Cl.
*B66C 23/78* (2006.01)

(52) U.S. Cl. ..... 212/301; 180/6.7; 212/233

(58) Field of Classification Search ..... 212/233, 212/301; 180/6.7

See application file for complete search history.

(56) References Cited

U.S. PATENT DOCUMENTS

| | | | | |
|---|---|---|---|---|
| 3,140,857 | A * | 7/1964 | Nickles | 254/281 |
| 3,868,022 | A * | 2/1975 | Greenlay et al. | 212/291 |
| 4,350,254 | A * | 9/1982 | Noly | 212/279 |
| 4,537,317 | A * | 8/1985 | Jensen | 212/301 |
| 4,601,402 | A * | 7/1986 | Helm et al. | 212/301 |
| 2006/0273057 | A1 * | 12/2006 | Zollondz et al. | 212/233 |

FOREIGN PATENT DOCUMENTS

| | | | |
|---|---|---|---|
| DE | 20 2005 017 362 | U1 | 3/2006 |
| DE | 20 2006 002023 | U1 | 7/2007 |
| JP | 2000-185893 | | 7/2000 |
| JP | 2001-171981 | | 6/2001 |
| JP | 2001-173475 | | 6/2001 |
| JP | 2002-002526 | | 1/2002 |
| JP | 2006-315864 | | 11/2006 |
| SU | 644368 | A * | 1/1979 |

* cited by examiner

*Primary Examiner*—Thomas J Brahan
(74) *Attorney, Agent, or Firm*—Oblon, Spivak, McClelland, Maier & Neustadt, L.L.P.

(57) ABSTRACT

A combination crane A is formed by connecting two crawler cranes 1L and 1R. Each crawler crane is provided with at least a lower propelling body 3 which can be propelled by crawlers 2, an upper revolving body 5 rotatably mounted on the lower propelling body 3 by a swing unit 4 provided between them, a boom 6 whose base section is tiltably supported on the upper revolving body, a tilting mechanism 10 that raises and lowers the boom and a hoist mechanism that hoists and lowers the lifting members 12 hung by a hoist rope 11 from the top of the boom. Both upper swing bodies of two cranes are connected together with a connecting beam 20. Swing motion is performed by driving the one crawler crane to move around the other crawler crane which is free to rotate and is locked against propulsion.

11 Claims, 14 Drawing Sheets

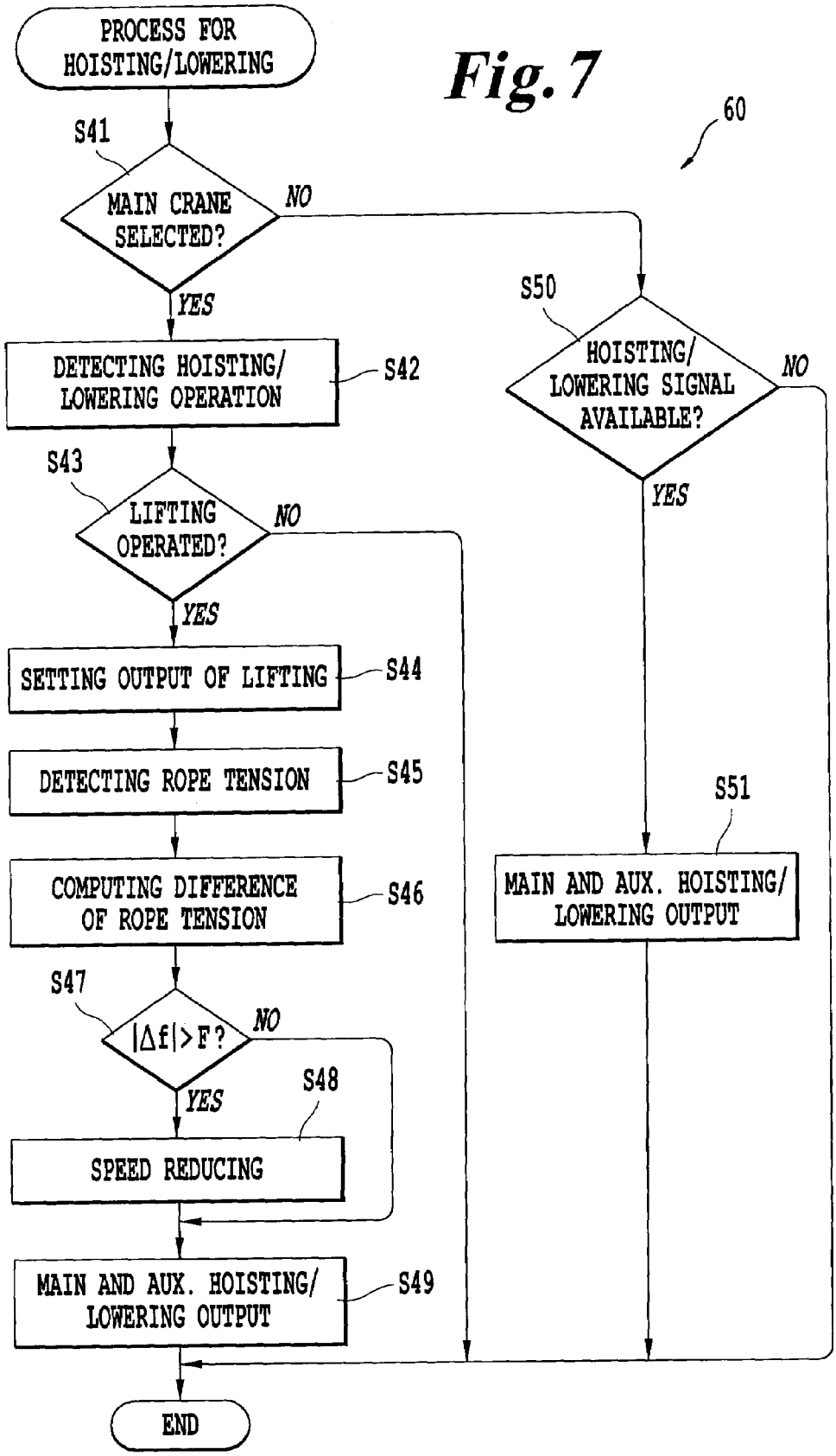
PROCESS FOR HOISTING/LOWERING
Fig. 7
60
S41
MAIN CRANE SELECTED?
NO
YES
DETECTING HOISTING/ LOWERING OPERATION
S42
S43
LIFTING OPERATED?
NO
YES
SETTING OUTPUT OF LIFTING
S44
DETECTING ROPE TENSION
S45
COMPUTING DIFFERENCE OF ROPE TENSION
S46
S47
|Δf|>F?
NO
YES
S48
SPEED REDUCING
MAIN AND AUX. HOISTING/ LOWERING OUTPUT
S49
END
S50
HOISTING/ LOWERING SIGNAL AVAILABLE?
NO
YES
S51
MAIN AND AUX. HOISTING/ LOWERING OUTPUT PROCESS FOR PROPELLING
63
S101
MAIN CRANE SELECTED?
NO
YES
DETECTING DISPLACEMENT OF PROPELLING CONTROL LEVER
S102
S103
PROPELLING OPERATED?
NO
YES
SETTING PROPELLING OUTPUT
S104
DETECTING SWING ANGLE
S105
DETECTING BEAM ANGLE
S106
DETECTING BEAM LENGTH
S107
ADJUSTMENT
S108
MAIN AND AUX. CRANES PROPELLING OUTPUT
S109
S110
PROPELLING SIGNAL?
NO
YES
S111
AUX. CRANE PROPELLING OUTPUT
END

COMBINATION CRANE

BACKGROUND OF THE INVENTION

1. Field of the Invention

The present invention relates to a combination crane that integrates a plurality of crawler cranes in order to lift heavy materials.

2. Description of Related Art

Conventionally, in order to lift heavy materials, a so-called "multi-crane lift" which uses two crawler cranes is usually used. However, in said multi-crane lift, as load distribution to the respective cranes in operation changes in accordance with their operation postures, it is conventional to use two crawler cranes whose lifting capacities are enough to lift 100% of the working load respectively. Accordingly, when a lifting operation needing the double lifting capacity of the respective cranes is conducted, it is necessary to prepare two crawler cranes with the double lifting capacity. In this case, it is necessary to use a plurality of cranes so that a larger working space is needed and running cost becomes higher.

On the other hand, as a capacity increasing device which is available to increase its rated lifting capacity to one class higher than its original capacity, some devices are known, for example, a device capable of exchanging its booms, reinforcing its mast or connecting to a counterweight dory. However, such devices need heavier booms for replacement or an additional counterweight dory. Besides, in this case, crane work can not be performed for a load more than that of a single unit, because the crane itself is a single crane.

Therefore, in order to improve the efficiency of the crane operation without wasted working space and additional running cost, a self-propelling type combination crane is demanded, which works independently under normal working condition and also functions as a combination crane when it lifts a heavy material that a single crane can not handle. As a combination crane which fulfills this requirement, the crane shown in Japanese Patent Laid Open No. 2006-315864 (U.S. patent publication 2006/0273057) is known for example. This combination crane connects lattice boom members of two lattice boom cranes that are closely positioned in parallel. The mechanisms for tilting their lattice booms are mechanically or electrically operated in a synchronized timing in order to synchronously tilt two lattice booms.

However, as this combination crane is firmly connected by means of the lattice connection member, the direction of the main body and lattice boom of each crane can not change. This characteristic renders this conventional combination crane problematic when it is put into practical service.

SUMMARY OF THE INVENTION

An object of the present invention is, in reference with a combination crane that doubles the lifting capacity by connecting more than two cranes, to provide a combination crane that makes it feasible to change its direction by moving bodies and booms, and that is able to double its lifting capacity.

The present invention relates to a combination crane connecting two crawler cranes so as to conduct a crane operation. Each crawler crane comprises a lower propelling body having crawlers, an upper revolving body installed on the lower propelling body, a boom whose base section is tiltably supported on the upper revolving body, a tilting mechanism that hoists and lowers the boom and a hoist mechanism that hoists and lowers a lifting member that is hung by a hoist rope from a top of said boom. In addition, these two upper revolving bodies are connected to each other by means of a connecting beam. The combination crane conducts swing motion when the one crawler crane which is rotatably locked moves and swings around the other crawler crane which is free to rotate and whose crawlers are locked.

By the above explained combination crane, when two crawler cranes whose upper revolving bodies are connected each other turn their direction, the one crawler crane which is rotatably locked is moved by its crawlers to swing around the other crawler crane which is free to rotate and whose crawlers are locked. By this motion, the combination crane can achieve its swing motion. Therefore, like one large crawler crane, without giving any hindrances to other crane operations, the combination crane can double its lifting capacity.

In the present invention, it is preferable that the connecting beam is rotatably connected to both of the upper revolving bodies of two crawler cranes so as to rotate around an approximately horizontal axis. In this case, when two crawler cranes come to locate on a different ground level individually, the connecting beam rotates around the approximately horizontal axis. Therefore, the connecting beam and its connecting portions to the crawler cranes are free from excessive bending moment in a vertical direction, and consequently do not suffer from any damages.

In the present invention, it is preferable that the connecting beam is rotatably connected to the upper revolving body of the one of two crawler cranes so as to rotate around an approximately vertical axis. In this case, when the one crawler crane runs out of a tangential line on a predetermined circle, the connecting beam pivotally rotates on the approximately vertical axis. Therefore, the connecting beam itself and its connecting portion to the other crawler crane are free from excessive bending moment and consequently do not suffer damage. Here, the predetermined circle is formed by the circle whose center is the center of the swing motion of the combination crane, and whose radius approximately equals to the distance between the centers of the one crawler crane and the other crawler crane.

In the present invention, it is preferable that the connecting beam is able to telescopically move along an axial direction of the beam within a predetermined range. In this case, while the combination crane is swung, if the other crawler crane runs out of the predetermined circle, the connecting beam can telescope to prevent the connecting beam suffering from excessive tension and compression stresses, and therefore the combination crane does not suffer damage.

In the present invention, it is preferable to provide a connecting beam length detecting means for detecting the length of the connecting beam. In addition, it is also preferable to provide a swing and propel control means that controls the propelling motion of the lower propelling body of the other crawler crane which is rotatably locked. This control is conducted based on a signal from the beam length detecting means. In this case, while a combination crane of the present invention is swinging, the lower propelling body of the other crawler crane travels along the predetermined circle under the control by a swing and propel control means based on the length of the connecting beam detected by the beam length detecting means. Therefore, the connecting beam does not suffer from an excessive load, and consequently the combination crane of the present invention can achieve more accurate swing motion.

When the beam length detecting means detects that the length of the connecting beam is out of a predetermined range, it is necessary to adjust the orbit of the other crawler crane and to bring it back to the predetermined circular orbit. In the case that the length of the connecting beam is out of the predetermined range, there exist two situations, the one is the case that the other crawler crane is brought to the predetermined circular orbit and the other is the case that the other crawler crane still keeps traveling out of the predetermined circular orbit.

In the present invention, it is preferable to adjust the orbit after deciding whether the other crawler crane is in the motion for adjusting the orbit or not. Specifically, it is preferable to provide a beam angle detecting means that detects a swing angle of the connecting beam around the approximately vertical axis. The swing and propel control means, based on the signals from the beam angle detecting means, controls the swing and propel motion of the lower propelling body of the other crawler crane which is rotatably locked. In this case, the swing and propel control means, based on the signals from the beam angle detecting means, decides whether the other crawler crane is in the motion adjusting the orbit or not. Moreover, if the motion adjusting the orbit is conducting, the propelling motion of the other crawler crane is held as it is. If the adjustment motion is not carried out yet, the swing and propel control means controls the propelling motion of the other crawler crane, so that the lower propelling body of the other crawler crane is brought to the predetermined orbit.

Each one of the crawler cranes of the present invention is preferably provided with a load detecting means that detects a load of a lifting material suspended by lifting members. Receiving signals from each load detecting means, a master hoist control means controls the hoist mechanism of each crawler crane, so that the difference in load may fall within the predetermined range. In this case, when the lifting material is hoisted or lowered, the hoist mechanisms of each crawler crane are controlled by the master hoist control means that receives the signals from the load detecting means so as to keep the difference in the loads of the lifting material applied to each crawler crane within the predetermined range. Therefore, the load applied to each crawler crane is almost equalized, and consequently the hoisting and lowering operation is stabilized.

Each one of crawler cranes used for the present invention is preferably provided with a boom angle detecting means for detecting the boom angle. Receiving signals from the boom angle detecting means, a master tilting control means controls the tilting mechanisms of the crawler cranes so that the difference in the detected angles may fall in the predetermined range. In this case, when the booms of the crawler cranes are raised or lowered, the tilting mechanisms of the crawler cranes are controlled by the master tilting control means that receives the signals from the boom angle detecting means in order to keep the difference between the boom angles of the crawler cranes within the predetermined range. Therefore, as the booms of the crawler cranes are raised and lowered almost synchronously, the horizontal movement of the lifting materials with boom raising and lowering motions is conducted stably.

In the present invention, when the combination crane is traveling forward or backward, it is preferable to control the propelling motion of the lower propelling bodies. In another wards, when two crawler cranes of the combination crane move forward or backward in parallel, if any difference of the propel speed occurs between two crawler cranes, one of these two crawler cranes precedes the other crawler crane so that the parallel propelling motion of the crawler cranes is disturbed. Therefore, it is preferable to cope with this problem.

Specifically, in the present invention, it is preferable to provide a beam angle detecting means for detecting a beam angle of the connecting beam around the approximately vertical axis, a swing angle detecting means for detecting a swing angle of the upper revolving body of the one of the crawler cranes which is free to rotate, and a parallel propelling means for controlling both of the crawler cranes to move in parallel based on angles detected by the beam angle detecting means and the swing angle detecting means. In this case, when a combination crane moves forward or backward, based on the signals from the beam angle detecting means, a parallel propelling means decides whether the direction of the upper revolving bodies of both crawler cranes is the same or not. Further, the parallel propelling means also decides, based on the signal detected by the swing angle detecting means, whether the direction of the upper revolving body of the one crawler crane heads toward the propelling direction of the lower propelling body or not. If each direction of both upper revolving bodies is the same and in addition the upper revolving body of the one crawler crane heads toward the propelling direction, the crawler cranes are propelling in parallel, and accordingly the propelling controls for the crawler cranes are kept as it is. On the contrary, if the upper revolving bodies of both crawler cranes are not facing to the same direction, or if the upper revolving body of the one crawler crane is not facing to the propel direction, the parallel motion of the crawler cranes is disturbed, and therefore the parallel propel control should be restored so that the crawler cranes may move in parallel again. In order to restore the parallel propelling control, it is effective to increase or decrease the propelling speed of at least one of two crawler cranes, or to steer at least one of two crawler cranes to the right or the left.

Moreover, in the present invention, it is preferable that the combination crane is provided with a beam length detecting means for detecting a length of the connecting beam, a swing angle detecting means for detecting a swing angle of the upper revolving body of the one of the crawler cranes which is free to rotate, and a parallel propelling means for controlling both of the crawler cranes to move in parallel, based on a swing angle detected by the swing angle detecting means and on a length detected by the beam length detecting means. In this case, when the combination crane moves forward or backward, based on the signals from the beam length detecting means, the parallel propelling means decides whether the distance between both crawler cranes is within the predetermined range or not. In addition, based on the signals from the swing angle detecting means, the parallel propelling means also decides whether the direction of the upper revolving bodies of the one crane heads towards the propelling direction or not. Next, when the distance between both crawler cranes is within the predetermined range and the upper revolving body of the one crane heads towards the propelling direction, the crawler cranes are moving in parallel so that the propelling control is kept as it is. On the contrary, when the distance between both crawler cranes is out of the predetermined range or the direction of the upper revolving body of the one crane does not head towards the propelling direction, the parallel motion of the crawler cranes is disturbed so that the parallel propelling control should be restored so as to move in parallel again. In order to restore the parallel propelling control, it is applicable to increase or decrease a propelling speed of at least one of two crawler cranes, or to steer at least one of two crawler cranes to the right or the left.

Another preferable example in relation to the present invention is explained hereinafter. A deck frame is rotatably mounted on a lower propelling body of at least one crawler crane of two crawler cranes. Further, at least two upper revolving bodies of said crawler cranes are mounted on the deck frame in a row.

In this case, the swing motion of the cranes mounted on the deck frame is achieved by rotating the deck frame. When a multi-lift job is conducted by the at least two upper revolving bodies mounted on the deck frame, the lifting capacity of the combination crane becomes more than that of an individual crane.

Further, it is preferable to position the lower propelling bodies of the crawler cranes in parallel and to provide the deck frame mounted over the lower propelling bodies. The deck frame comprises a lower part, an upper part and a swing unit that is provided between the lower and upper parts. On the upper part, the upper revolving bodies of said the two crawler cranes are mounted in a row. In this case, as at least two upper revolving bodies of the crawler cranes are mounted on at least two lower propelling bodies of the crawler cranes, so the stability of said the combination crane of the present invention is much more improved than that of conventional crawler cranes.

Another preferable example in relation to the present invention is explained hereinafter. A larger crawler crane and smaller crawler cranes whose lifting capacity is smaller than that of the larger crawler crane are prepared. More than two upper revolving bodies of the smaller crawler cranes are installed on a deck frame mounted on a lower propelling body of the larger crawler crane. In this case, by using the lower propelling body of the larger crawler crane, better stability can be secured. Moreover, by mounting more than two upper revolving bodies of the smaller crawler cranes on the lower propelling body of the larger crawler crane, it is possible for the combination crane to conduct a multi-lift job whose lifting capacity exceeds the lifting capacity of each smaller crawler crane. In addition, the total sum of the lifting capacity of the upper revolving bodies of the smaller crawler cranes mounted on the deck frame can be preferably higher than that of the larger crawler crane.

BRIEF DESCRIPTION OF THE DRAWINGS

FIG. 7 is a flow chart showing a sub-routine of setting process for hoisting and lowering of the combination crane;

DETAILED DESCRIPTION OF THE PREFERRED EMBODIMENTS

Hereinafter, based on the drawings, a description is given to an embodiment which is the best mode to carry out the present invention.

Figure 1:
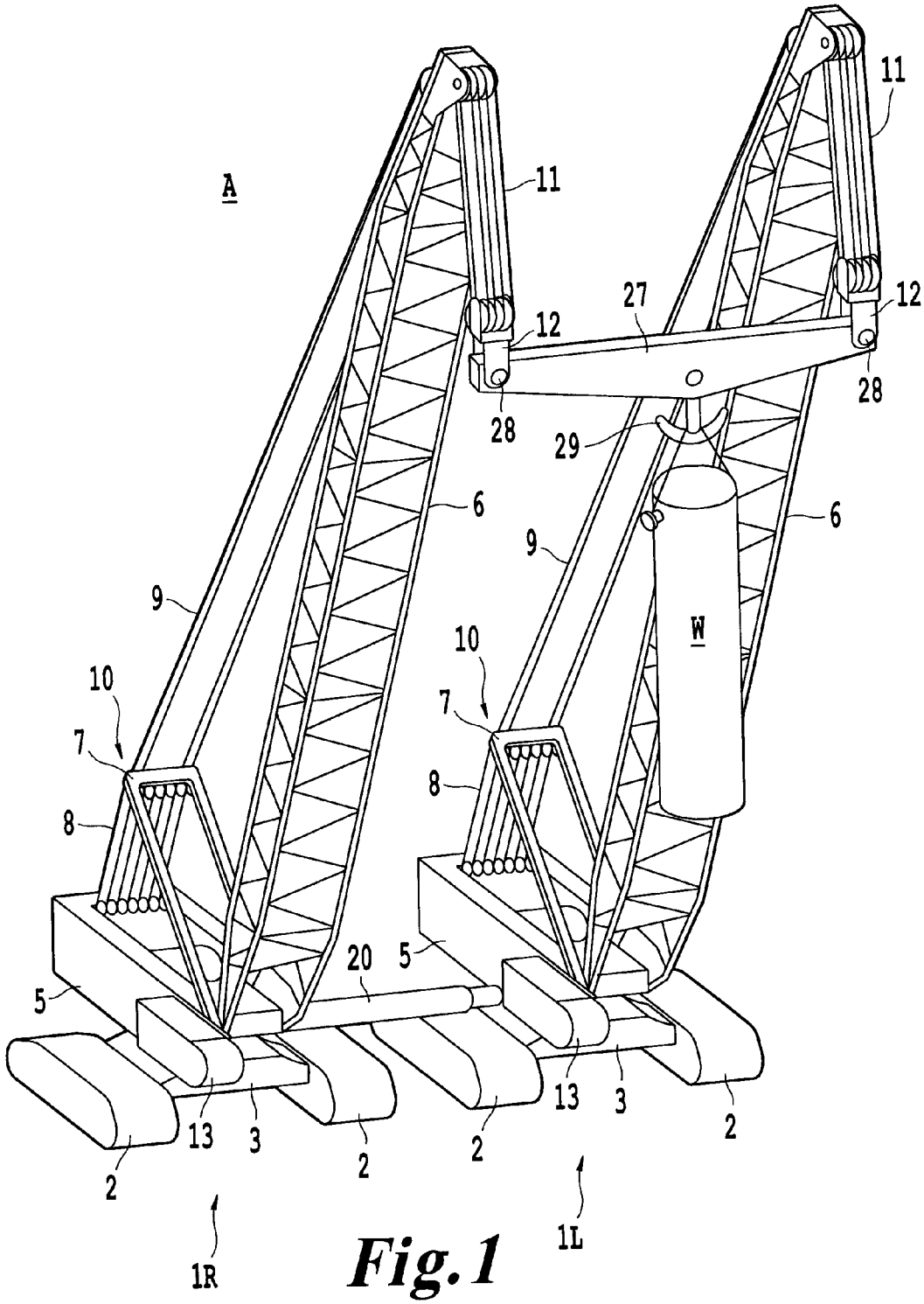
FIG. 1 is a perspective view of a combination crane showing the first embodiment of the present invention.

FIG. 1 shows a combination crane A according to the first embodiment of the present invention. The combination crane A works as a crane by combining two crawler cranes 1L and 1R with the identical model and characteristics respectively. Each one of them can work as a single crane independently.

Figure 2:
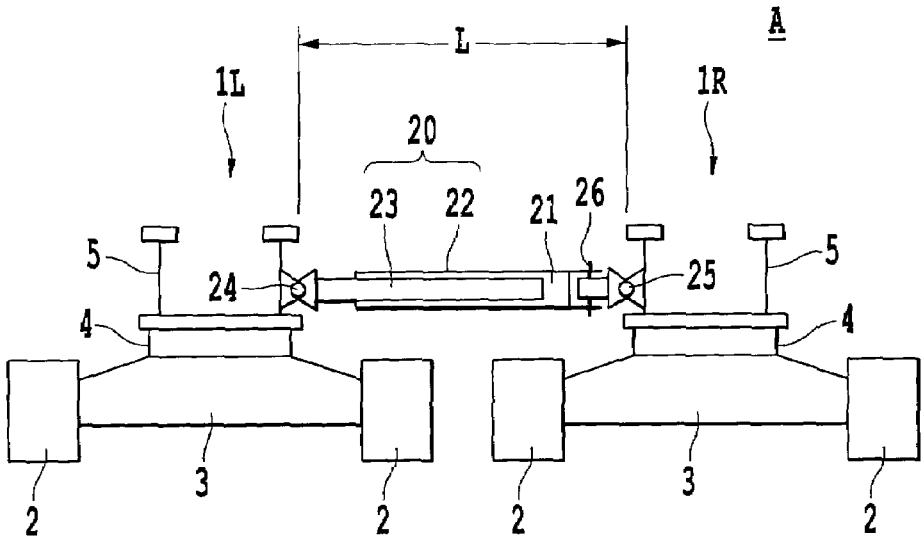
FIG. 2 is an outline view in the vicinity of connecting beam of the combination crane.

As shown in FIG. 2, each crawler crane 1L and 1R is provided with a lower propelling body 3 having crawlers 2 on each right and left side for propelling the crane. On this lower propelling body 3, an upper revolving body 5 is mounted by means of a swing unit 4. On the front of this upper revolving body 5, a lattice type boom 6 is tiltably mounted. This tilting mechanism 10 for tilting the boom 6 comprises a mast 7, a boom hoist wire rope 8 and a boom guy line 9 and so on. Each crawler crane 1L and 1R is provided with a hoist mechanism (not shown) that winds up or down lifting members 12 hung down from the tops of the booms 6 with hoist wire ropes 11, and an operator cab 13 that is located at the front of an upper revolving body 5 where a base section of the boom 6 is attached. In the operator cab 13, there is an operator seat around which various kinds of control levers and switches are properly arranged.

Both upper revolving bodies 5 of said crawler cranes 1L and 1R are connected to each other in the vicinity of the swing units 4 by means of a connecting beam 20. It is preferable, for example, to locate the connecting beam 20 on the line that connects the center axes of swing motions of the crawler cranes 1R and 1L in a state that both cranes are positioned in parallel in alignment with their front and rear end portions. Moreover, the connecting beam 20, as shown in FIG. 2, comprises a sleeve 22 with a hollow 21 in the center and a shaft 23 inserted into the hollow 21 so as to move along the axis direction. Therefore, the axis direction length L of the connecting beam 20 is variable within the length of moving distance of the shaft 23. One end of the connecting beam 20 is rotatably attached to a horizontal shaft 24 of the crawler crane 1L that is located on the left side of the working vehicle A as viewed from the front side. The other end of the connecting beam 20 is connected to the right side crawler crane 1R with respective shaft members or a universal joint, so that it may rotate both vertically on a horizontal shaft 25 and horizontally on a vertical shaft 26.

Next, lifting members 12 of said two crawler cranes 1L and 1R are connected to either end of a lifting beam 27 with fixtures 28 like connecting pins. At the center of this lifting beam 27, a double hook 29 is provided in order to lift a heavy weight W. Hereinafter, if it is necessary to discriminate the cranes 1L and 1R, the crane 1L on the left is named a main crane and the right 1R an auxiliary crane.

Figure 3:
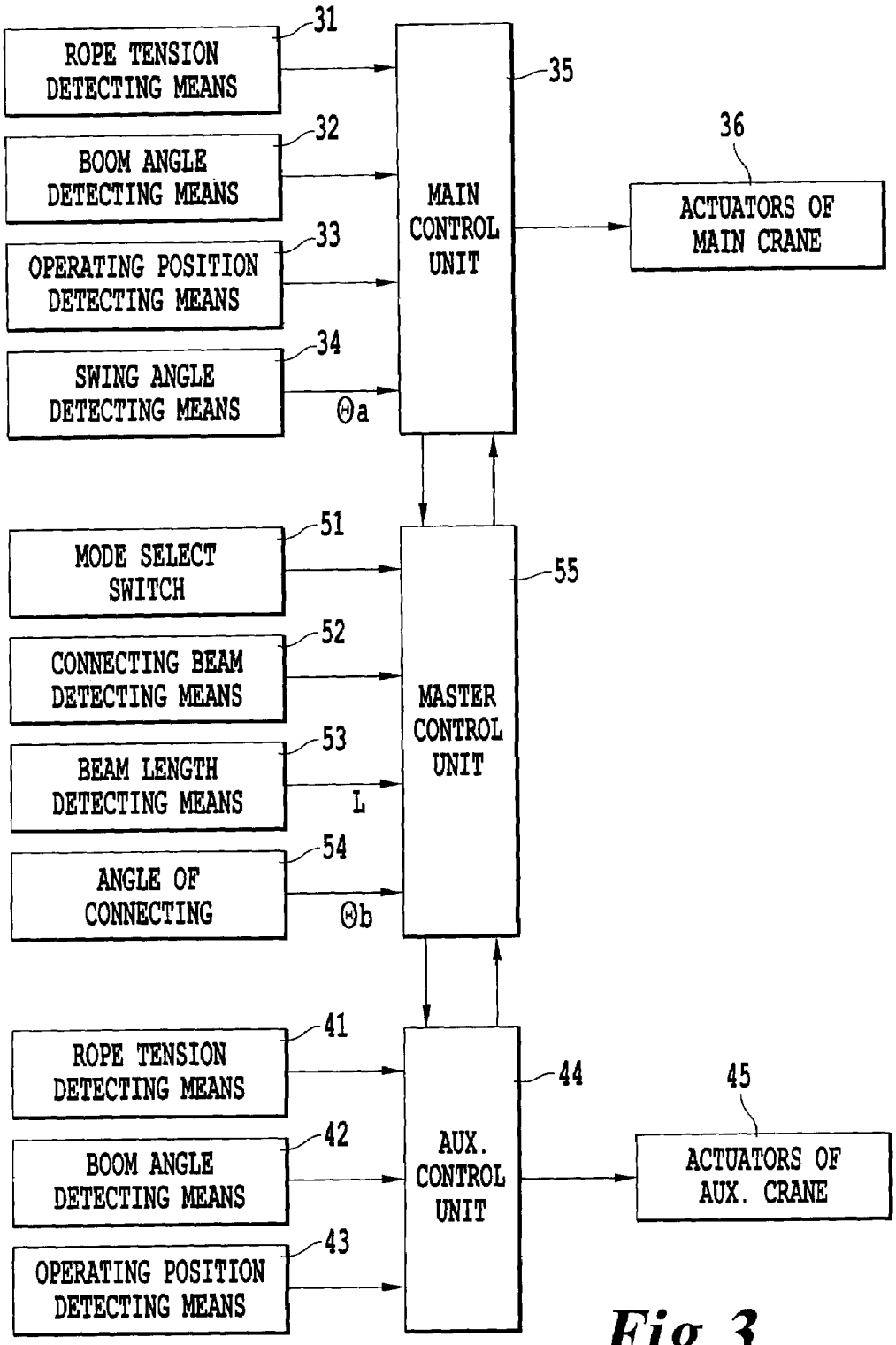
FIG. 3 is a block diagram of control system of the combination crane.

FIG. 3 shows a block diagram of a control system of said combination crane A. A rope tension detecting means 31 (load detecting means) measures the tension of the hoist rope 11 i.e., the weight W of the material lifted by the main crane 1L. A boom angle detecting means 32 measures the angle of the boom 6 of the main crane 1L. An operating position detecting means 33 (potentiometers for example) detects the displacement of various kinds of levers and switches in the operator cab 13 of the main crane 1L. A swing angle detecting means 34 detects swing angle θa (shown in FIGS. 13 and 14) of the upper revolving body 5 of the main crane 1L. The signals detected by those detecting means 31 to 34 are sent to a main control unit 35 of the main crane 1L. This main control unit 35 controls various kinds of actuators 36 such as hydraulic cylinders or motors by means of respective control valves (not shown) installed on the main crane 1L.

Next, a rope tension detecting means 41 (or weight detecting means) measures the tension of the hoist rope 11 of the auxiliary crane 1R, i.e., the weight W of material lifted by the auxiliary crane 1R. A boom angle detecting means 42 measures the angle of the boom 6 of the auxiliary crane 1R. An operating position detecting means 43 detects the displacement of various kinds of levers and switches in the operator cab 13 of the auxiliary crane 1R. The signals detected by these detecting means 41 thru 43 are sent to an auxiliary control unit 44 of the auxiliary crane 1R. The auxiliary control unit 44 controls various kinds of driving mechanisms comprising actuators 45 such as hydraulic cylinders or motors by means of respective control valves (not shown) installed on the auxiliary crane 1R.

Figure 12A:
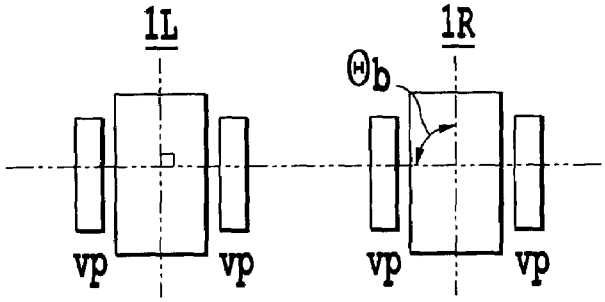
FIGS. 12 to 14 are explanatory views to explain the propelling control system of the combination crane.
Figure 12B:
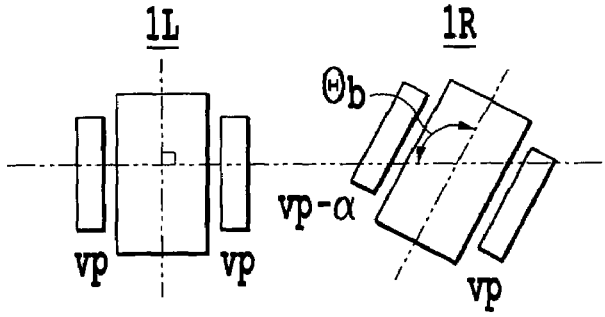
Figure 12C:
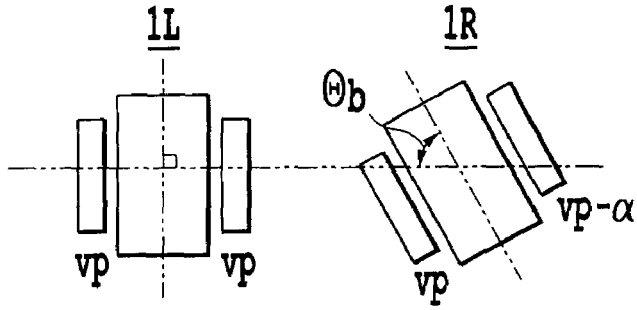
Figure 13A:
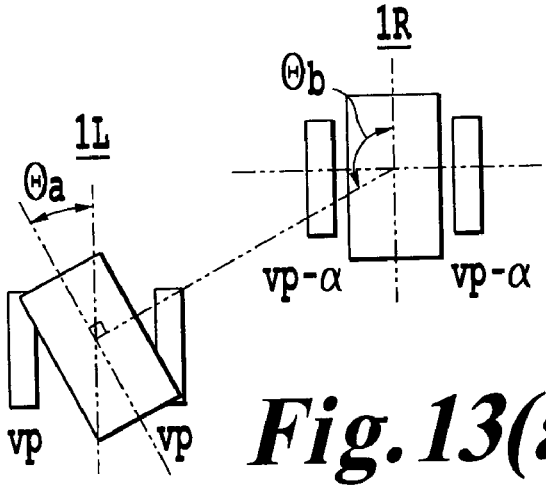
Figure 13B:
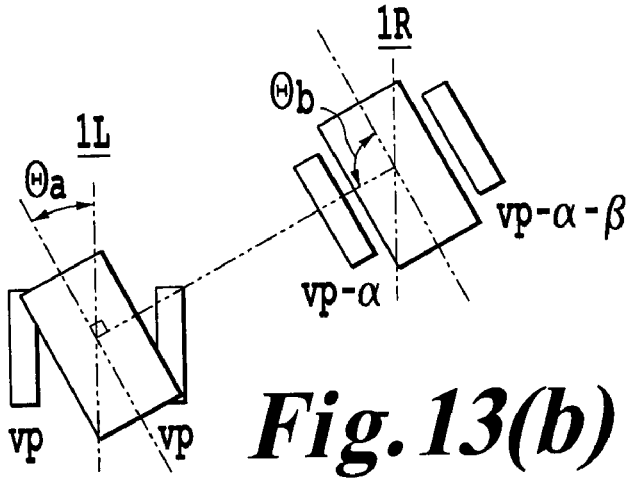
Figure 13C:
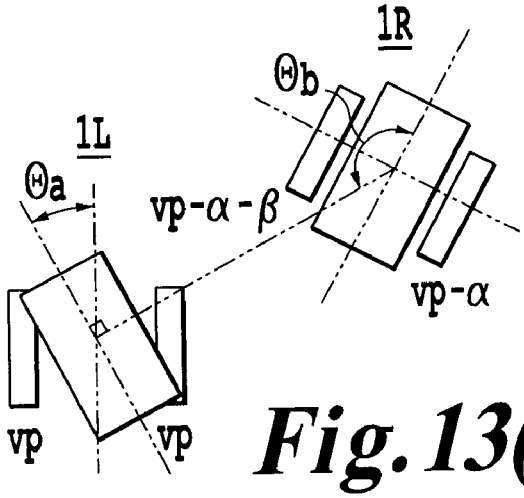
Figure 14A:
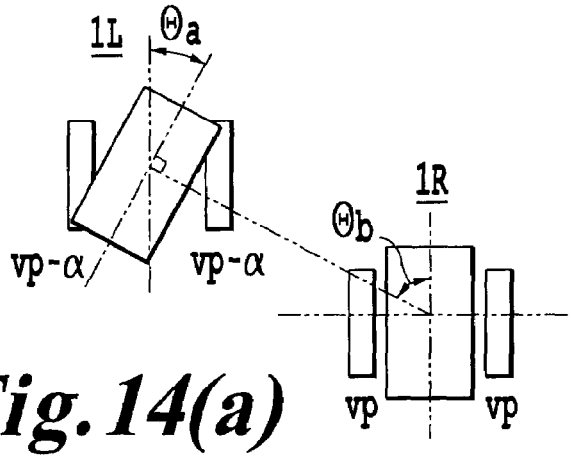
Figure 14B:
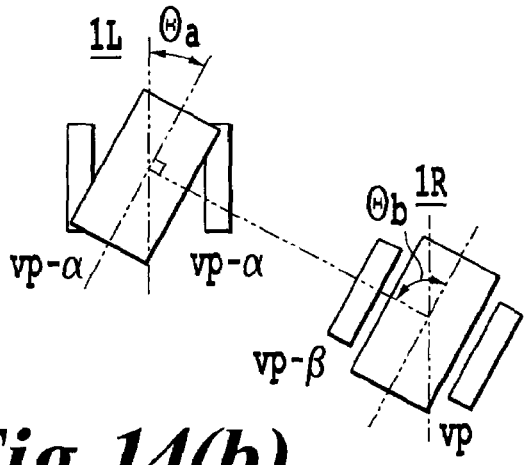
Figure 14C:
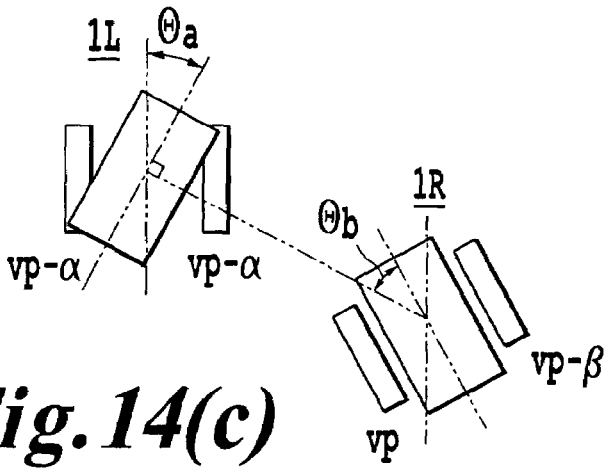

Furthermore, a mode select switch 51 is provided in the operator cab 13 of the main crane 1L for switching from a combined mode to a non-combined mode. A connecting beam detecting means 52 detects the state of the connecting beam 20; whether it is installed or not. A beam length detecting means 53 detects the length L of the beam 20 when it is installed (see FIG. 2). A beam angle detecting means 54 detects the horizontal angle θb of the beam 20. The horizontal angle θb means specifically the one formed by the centerline of the auxiliary crane 1R and that of the beam 20 (as shown in FIGS. 12 to 14). The signals from the switch 51 and the detecting means 52 to 54 are sent to a master control unit 55. The master control unit 55 is installed in the main crawler crane 1L together with the main control unit 35. The master control unit 55 is wired to the main control unit 35 and the auxiliary control unit 44 respectively, so that the signals may be exchanged among them mutually. In addition, when the cranes 1L and 1R are connected together with the connecting beam 20 and used as a single combination crane A that is also referred to as a combined mode, the master control unit 55, cooperating with both main control units 35 and auxiliary control unit 44, controls the various kinds of actuators 36 and 45 for both main crane 1L and auxiliary crane 1R. Referring to FIG. 4 thru FIG. 9 and FIG. 11, the content of the control system is explained hereinafter.

Figure 4:
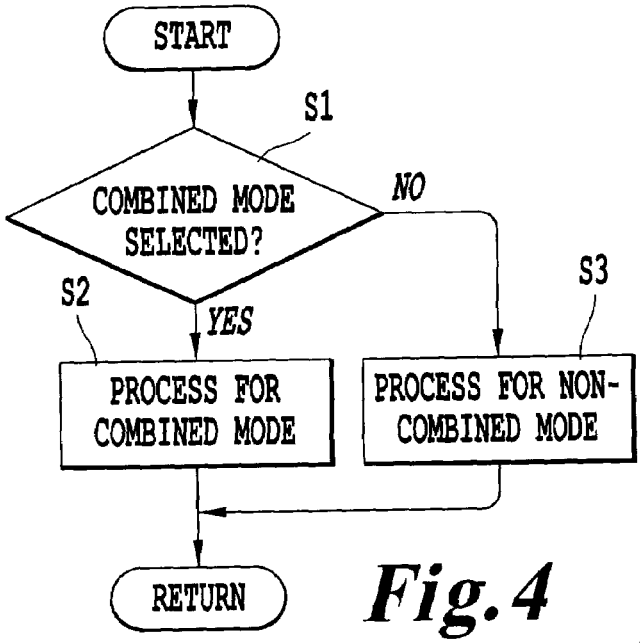
FIG. 4 is a flow chart showing how control system of the combination crane works.

In FIG. 4, first of all, according to a signal from the mode select switch 51, the step S1 checks whether the combined mode is selected or not. If the decision is YES, process for the combined mode is carried out in the step S2 and then returns. On the contrary, if the decision is NO, process for the non-combined mode is carried out in the step S3 and then returns. Process for the non-combined mode is a program to control two crawler cranes 1L and 1R independently. As controlling the combination crane A in the non-combined mode is almost the same as used for a conventional crawler crane, further explanations are omitted hereinafter.

(Process for Combined Mode)

In the meantime, the process for said combined mode in the step S2 is a program designed for controlling two crawler cranes 1L and 1R connected together and used as said combination crane A. The process for the step S2 is conducted according to the sub-routine shown in FIG. 5. Specifically, the process for setting main and auxiliary cranes is carried out in the step S11, and then the process for hoisting and lowering is carried out in the step S12, and then the process for boom raising and lowering in the step S13, and then the process for swinging is carried out in the step S14, and then the process for propelling is carried out in the step S15. After these steps are followed, the processes for the combined mode are completed.

(Process for Setting Main and Auxiliary Cranes)

Figure 6:
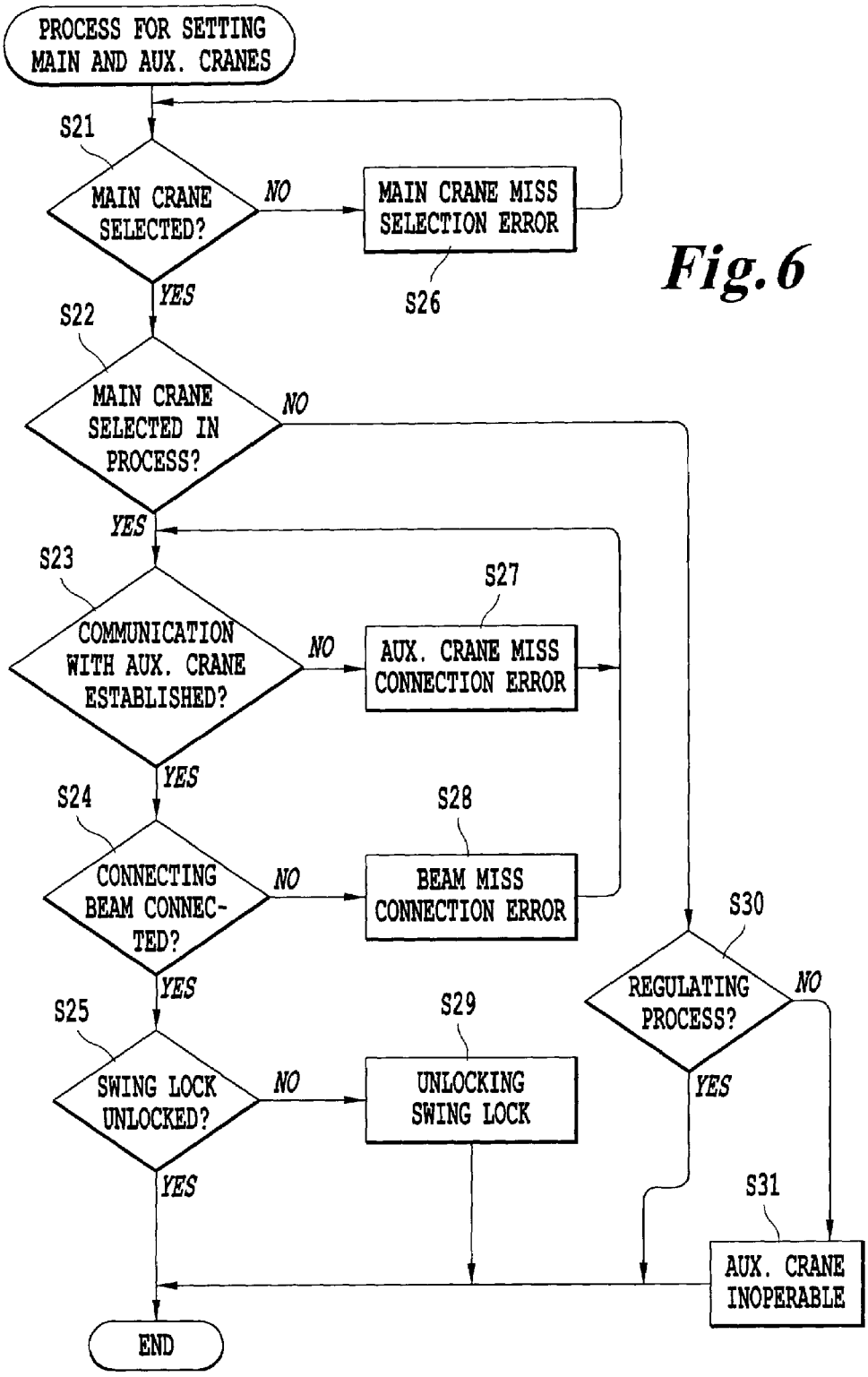
FIG. 6 is a flow chart showing a sub-routine of setting process for main and auxiliary machinery of the combination crane.

Said step S11 is executed according to the sub-routine shown in FIG. 6. First of all, in a step S21, it is discriminated whether either of two crawler cranes 1L, 1R has been set as a main crane or not. This discrimination is carried out by a signal from a switch for setting main and auxiliary cranes (not illustrated) that is provided together with a mode select switch 51 in the operator cab 13. In case of the present embodiment, the left side crane 1L is selected as the main crane 1L. When this discrimination is YES, which means a main crane has been already set, process proceeds to a step S22. On the contrary, when the discrimination turns out NO, which means main crane has not been set yet, the process proceeds to a step S26 and then returns to the step S21 showing an error message "the main crane not selected" on a display panel or warning the same by sound signals from a warning device (not shown) in the operator cab 13 of the main crane 1L.

In the step S22, the process for discriminating between main and auxiliary cranes is carried out. This process is adopted in accordance with the situation that the process of setting main and auxiliary cranes, i.e. the sub-routine to process for combined mode, commonly shows the control contents of both main control unit 35 including master control unit 55 and auxiliary control unit 44. In the case where the subroutine for processing combined mode judges it as the main control unit 35, which means the step S22 is discriminated YES, and then the processing proceeds to steps S23 to S25, and then steps S27 to S29. On the other hand, in the case where the sub-routine judges it as the auxiliary control unit 44, the processing proceeds to the steps S30 and S31.

Moreover, in case of the main control unit 35, first of all, the step S23 checks if communication with the auxiliary crane 1R (specifically the control unit 44) is established or not. If the decision is YES, further checking is conducted in the step S24 in accordance with a signal from a connecting beam detecting means 52 whether the connecting beam 20 has already been connected or not. If the decision is NO in the step S23, the step S27 causes the display panel or the like in the operator cab 13 of the main crane 1L to show an error message of incomplete connection. If the decision in the step S24 is NO, the step S28 causes the display to show an error message of beam miss-connection. After these steps are processed, the step S23 is resumed. If both decisions in the steps S23 and S24 are YES, the step S25 checks whether the swing unit 4 of the main crane 1L stays unlocked, namely whether it rotates freely or not, and then if the decision is YES, the process for setting main and auxiliary cranes completes immediately. On the contrary, if it is NO, the swing unit 4 of the main crane 1L should be unlocked so as to rotate freely in the step S29, and then the process is finalized.

Figure 5:
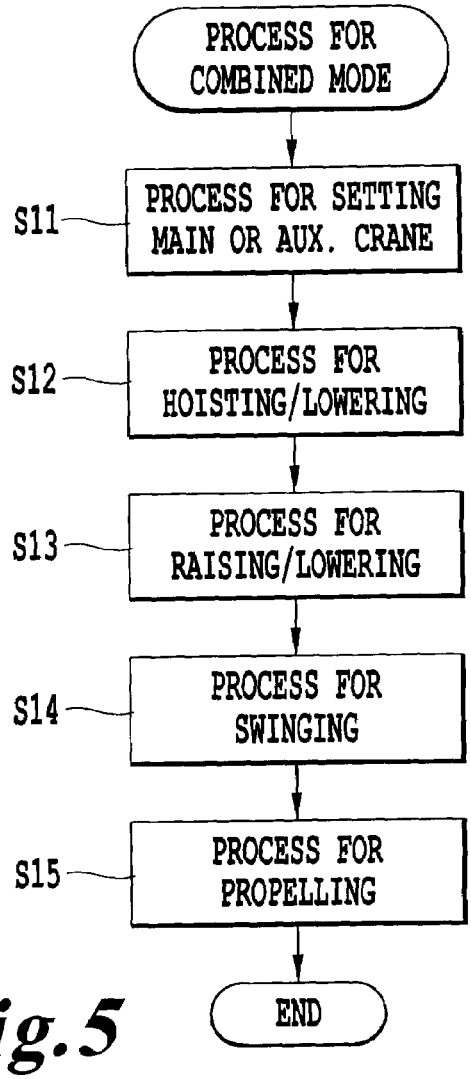
FIG. 5 is a flow chart showing a sub-routine to process a combined mode of the combination crane.

On the other hand, in case of the control unit 44 for the auxiliary crane 1R, the step S30 checks whether a regulating process has been activated or not. If the decision is YES, the processing for setting main and auxiliary cranes completes immediately. On the contrary, if it is NO, the operation from the auxiliary crane 1R should be made partially inoperable in the step S31, and then the process for setting main and auxiliary cranes completes. Now, as examples of operation to be made inoperable, the steps S12 to S15 shown in FIG. 5 are mentioned referring to the operations for each hoisting/lowering, boom raising/lowering, swinging and propelling. As an example of inappropriate operation to be made inoperable, the process for braking hoist winch (specifically braking for freefalling) is mentioned.

(Process for Hoisting/Lowering)

The hoisting/lowering step S12, according to the subroutine shown in FIG. 7, decides first of all in a step S41, which one is selected as the process for setting main and auxiliary cranes, the main crane 1L i.e. the main control unit 35 or not.

If the decision is YES, i.e. the main control unit 35 is selected, after the amount of operation is detected by the operating position detecting means 33 (specifically, detecting means for displacement of control levers for hoisting and lowering) in a step S42, it is decided in a step S43 whether lifting operation is made or not. If the decision is YES, the process proceeds to a step S44. On the contrary, if the decision is NO, the process for hoisting/lowering terminates immediately.

Process for setting output of lifting is made in accordance with the amount of displacement of control lever in the step S44. Then, in a step S45, the tensions of hoist wire ropes 11 of the main crane 1L and the auxiliary crane 1R are detected based on signals sent from rope tension detecting means 31 and 41 of the cranes 1L and 1R respectively. Then, the difference of the wire rope tensions between both cranes is computed in a step S46, and consequently an absolute value of the difference Δf is checked in a step S47, whether it is larger than the limited value F or not.

Now, a weight W together with the lifting beam 27 and the double hook 29 being suspended by the lifting member 12 of both main crane 1L and auxiliary crane 1R, the weight W is hung down by driving hoist winches of both main crane 1L and auxiliary crane 1R. When the hoist winches of both main crane 1L and auxiliary crane 1R are driven for hoisting and lowering the weight W being suspended, there will be a possibility of occurring slight differences in hoisting and lowering speeds between two hoist winches of the main crane 1L and auxiliary crane 1R due to difference in characteristics of the two winches. Thus, when the speed difference in hoisting and lowering occurs, the lifting beam 27 will tend to slant to one side. When this slant increases too much, the load W will lose its stability, resulting in loading one-sidedly on either the main crane 1L or the auxiliary crane 1R. In order to avoid this situation, the rope tension detecting means 31 and 41 are provided with the hoist wire ropes 11 in order to detect the slant of the lifting beam 27. In another words, when the difference in height between two fixtures 28 of the main crane 1L and the auxiliary crane 1R is small enough to hold the lifting beam 27 in a horizontal position, it shows that both cranes 1L and 1R are loaded almost equally. In this case, the difference Δf between both data obtained by the rope tension detecting means 31 and 41 falls within the limited range ($-F \leqq \Delta \leqq F$). When the lifting beam 27 is to be held approximately parallel to the level like this, the hoisting and lowering speeds for both main crane 1L and auxiliary crane 1R are also maintained in proportion with the displacement of operating lever. On the contrary, when the amount of the slant of the lifting beam 27 is large, namely the difference in height between two fixtures 28 becomes larger so that either main crane 1L or auxiliary crane 1R is over-loaded. In this case, the difference in rope tension Δf obtained by the rope tension detecting means 31 and 41 falls outside the limited range ($\Delta f \leftarrow F$, $F < \Delta f$). Accordingly, in the case that the slant of the beam 27 becomes bigger than the limited value, it is necessary to adjust the hoisting and lowering speeds for both cranes 1L and 1R, so that the slant of the lifting beam 27 may return to the limited range. The hoisting and lowering speed adjustment (correction of slant of the lifting beam 27) needs different countermeasure for each hoisting and lowering. In case of hoisting, as the higher speed side comes to higher height with higher rope tension, so it is necessary to reduce the rope speed at the side of higher rope tension. On the contrary, in case of lowering, as the lower speed side remains higher with higher rope tension, so it is necessary to reduce the rope speed at the side of lower rope tension. In addition, the slant adjustment for the lifting beam 27 could not only be achieved by reducing the speed of the rope 11 at its higher side, but also could be done by increasing the speed of the hoist ropes 11 at the lower speed side. However, from the safety view point, it is appropriate to be achieved by reducing the rope speed.

From the aforementioned explanations, if the decision in the step S47 is YES, i.e. the absolute value of the difference Δf in rope tensions is larger than the limited value F, the hoisting speed of the hoist rope 11 at higher tension side will be reduced in a step S48. On the other hand, while lowering, the speed of the wire rope 11 at lower tension side should be reduced, so that the speeds of the wire ropes 11 for lowering may be equalized to the same speed at both cranes 1L and 1R.

Following the aforementioned processes, based on an output computed from said lifting output setting the step S44 and reducing the step S48, in a step S49, reference signals for hoisting and lowering are sent to both hoist mechanisms on the main and auxiliary cranes 1L and 1R. After this step, the process for hoisting/lowering is terminated.

On the contrary, if the decision in the aforementioned step S41 is NO, control advances to auxiliary control unit 44 in a step S50 where it is checked whether a lifting signal is generated from the main control unit 35 or not. This lifting signal means an output of the hoisting and lowering signals for the auxiliary crane 1R in the step S49. If the decision is YES, instruction of hoisting or lowering motion in response to the lifting signal from the main control unit 35 is given to the hoist mechanism of the auxiliary crane 1R in a step S51. Thereafter, the process for hoisting/lowering terminates. On the other hand, if the decision is NO, the process for hoisting/lowering terminates immediately.

The master hoisting control means 60 controls all of the hoist mechanisms of the main crane 1L and the auxiliary crane 1R, so that the lifting beam 27 may be held in an approximately horizontal position by adjusting the difference Δf in the rope tensions between the hoist ropes 11 of the main crane 1L and the auxiliary crane 1R to fall within the limited range, by means of the aforementioned subroutine for processing for hoisting/lowering and the control system comprising the main control unit 35, the auxiliary control unit 44 and the master control unit 55.

(Process for Boom Raising/Lowering)

Figure 8:
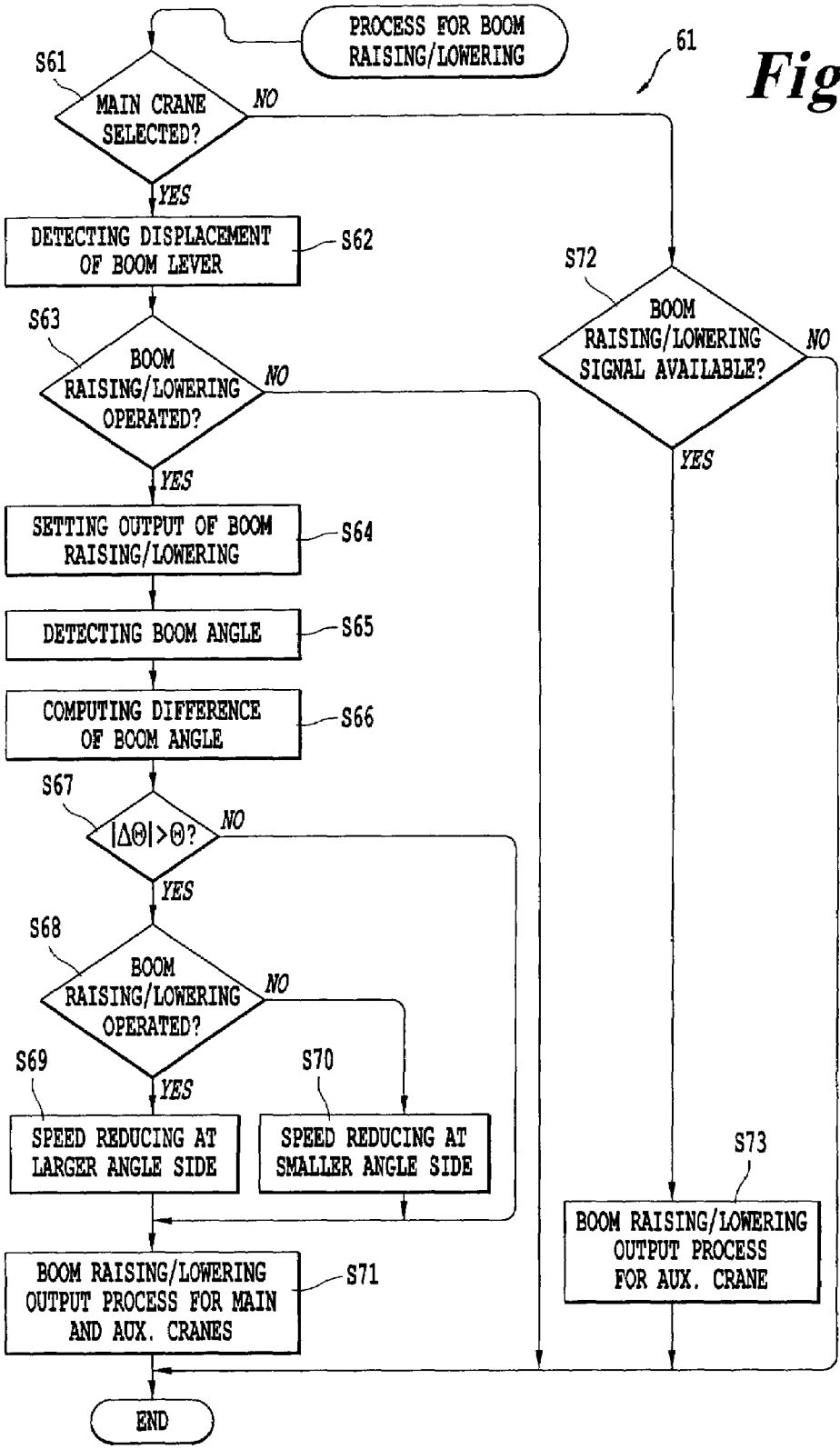
FIG. 8 is a flow chart showing a sub-routine to process a boom raising and lowering motion of the combination crane.

The boom raising/lowering process S13, according to the subroutine shown in FIG. 8, decides in step S61, which one is selected as main and auxiliary cranes, the main crane 1L i.e. the main control unit 35 or not.

If the decision is YES i.e., the main control unit 35, the amount of raising operation is detected in a step S62 according to signals from various kinds of control displacement detecting means 33 (specifically, detecting means of the displacement of boom raising control lever). Then, the S63 decides whether raising operation has been carried out or not based on the detected result. If the decision is YES, the process proceeds to a step S64. On the other hand, if it is NO, the raising process terminates immediately.

The process for setting the output for raising the boom is processed in the step S64 in proportion to said displacement of its control lever. Then, in a step S65, the angles of the booms 6 of both cranes 1L and 1R are respectively detected by the signals sent from the boom angle detecting means 32 and 42. Next, the difference of the angles between both booms is computed in a step S66, and consequently it is decided in a step 67 whether an absolute value of the difference $\Delta\theta$ is larger than a predetermined value $\theta$ or not. If the decision is YES, further decision is made in a step S68 to decide whether the operation is for raising the boom 6 (upward movement) or not. If the decision in the step S68 is YES, that is, if there is the difference of the angles $\Delta\theta$ that is larger than the predetermined value $\theta$ while the boom 6 is rising, the rising speed of the boom 6 on the side of larger angle is to be decreased in a step S69, so that the boom angles of both main crane 1L and auxiliary crane 1R may become the same as each other. On the contrary, if the decision in the step S68 is NO, that is, if there is the difference of the angle $\Delta\theta$ that is larger than the predetermined value $\theta$ while the boom 6 is lowering, the lowering speed of the boom 6 on the side of the smaller angle is to be decreased in a step S70, so that the boom angles of both main crane 1L and auxiliary crane 1R may become the same as each other.

Thereafter, a tilting motion signal is sent to the respective tilting mechanisms 10 of both main crane 1L and auxiliary crane 1R in a step S71, based on the outputs which are obtained from the aforementioned steps; S64 setting output of boom raising/lowering boom, and S69 speed reducing at larger angle or S70 speed reducing at smaller angle. Then, the boom raising/lowering process is terminated.

On the other hand, if the decision in the step S61 is No, i.e. the control unit 44, it is decided in a step 72 whether a reference signal for raising or lowering the boom is sent from the main control 35 or not. This reference signal is the output signal for raising or lowering the auxiliary crane 1R in the step S71. If the decision is YES, the output signal for raising or lowering the boom, based on the raising/lowering reference signal from the main control 35, is given to a tilting mechanism 10 of the auxiliary crane 1R in a step S73. Thereafter, the processing for raising or lowering terminates. On the other hand, if the decision is NO, the processing for raising/lowering terminates immediately.

A master tilting control means 61 totally controls the tilting mechanisms 10 of both cranes 1L and 1R respectively, so that the difference of the boom angles $\Delta\theta$ between the booms 6 of both cranes 1L and 1R may fall within the predetermined range by means of the aforementioned subroutine for processing raising or lowering, the main control unit 35, the auxiliary control unit 44 and master control unit 55.

(Process of Swinging)

Figure 9:
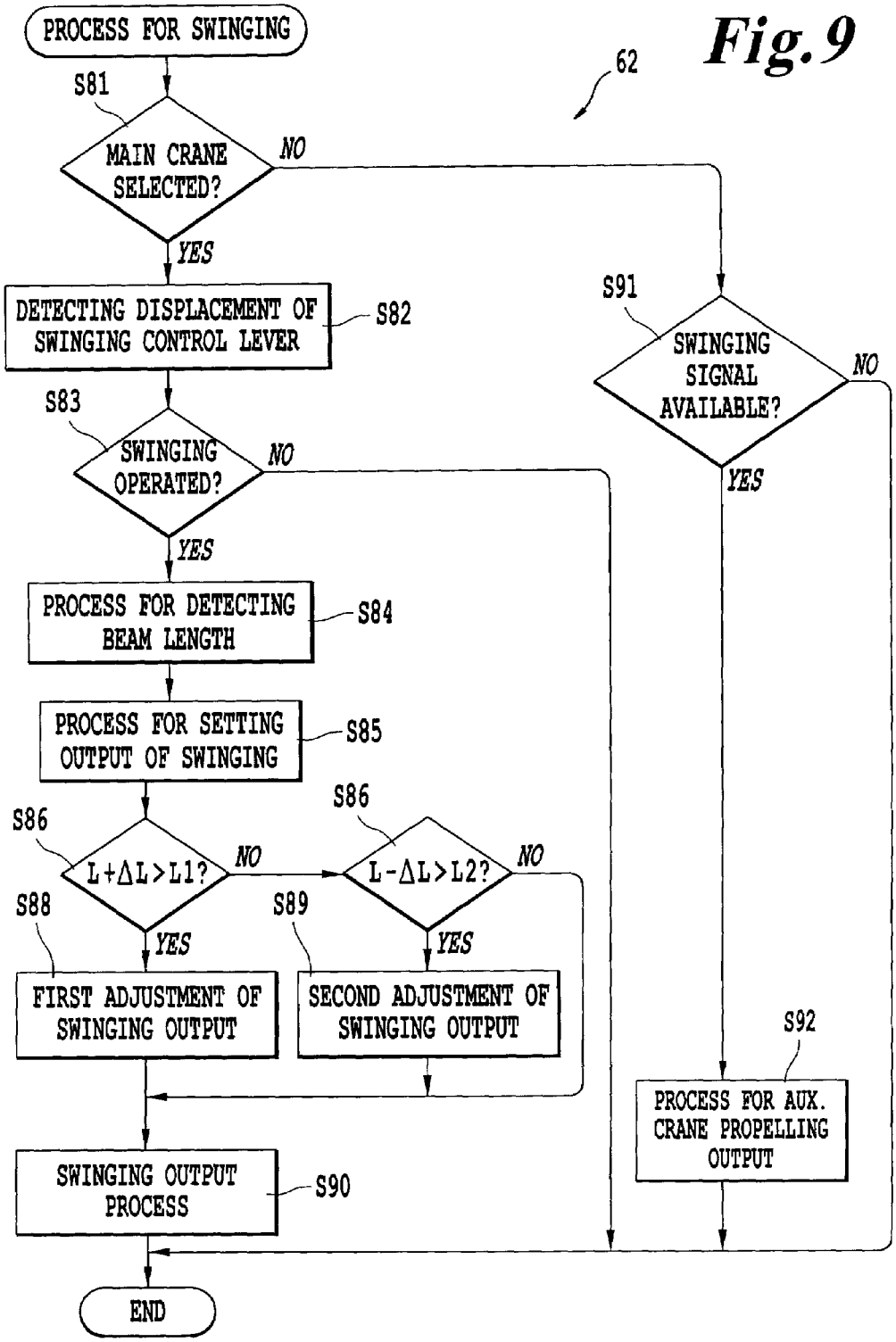
FIG. 9 is a flow chart showing a sub-routine to process swing motion of the combination crane.

The swing process S14, according to the subroutine shown in FIG. 9. decides first of all in a step S81, which one is selected as the main and auxiliary cranes.

If the decision is YES, i.e. the main control unit 35 of the main crane 1L, the amount of swing operation is detected in a step S82 according to reference signals from various kinds of control displacement detecting means 33 (specifically, detecting means for detecting the displacement of swing control lever). Then, the step S83 decides whether the swing operation has been carried out or not, based on the detected result. If the decision is YES, the process proceeds to a step S84. On the other hand, if the decision is NO, the process for swinging terminates immediately.

Figure 10:
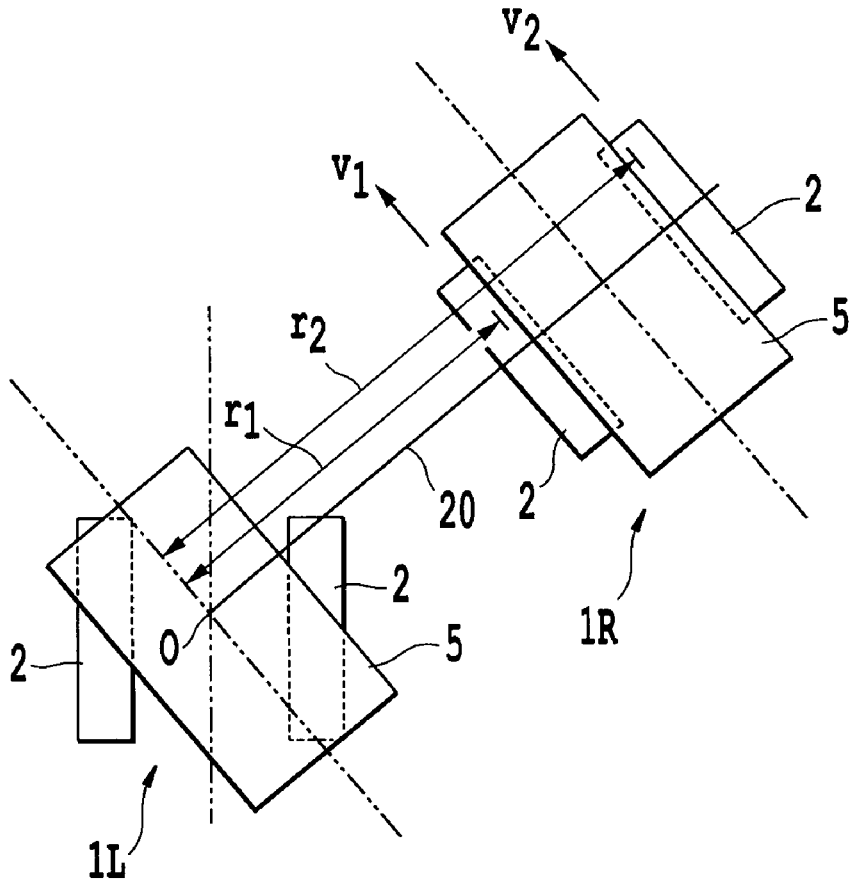
FIG. 10 is a schematic view to explain how the combination crane moves in swing motion.

The length L of the connecting beam 20 is measured in the step S84 based on signals from the beam length detecting means 53. Thereafter, in proportion to said amount of swing lever displacement, the process for setting swing output is carried out in the step 85. Now, when said combination crane A is in swing motion, keeping the main crane 1L stopped, whose the swing unit 4 is set free to rotate by the swing unit unlock process in step S29, the lower propelling body 3 of the auxiliary crane 1R with its swing unit 4 locked is propelled to swing. In this case, the inside crawler 2 and the outside crawler 2 of the lower propelling body 3 of the auxiliary crane 1R are respectively located at the different distance r1 and r2 from the center 0 of the swing unit 4 of the main crane 1L as shown in FIG. 10. Accordingly, different speeds of v1 and v2 ($=v1 \cdot r2/r1$) are to be set in the step S85.

Moreover, in a step S86, when the length L of the connecting beam 20 increases, a decision is to be made whether the total length ($L+\Delta L$) is longer than the specified length L1 or not. In a step S87, when the length L decreases, a decision is made whether the total length ($L-\Delta L$) is shorter than the specified length L2 or not. If the decision in the step S86 is YES, i.e., if the length L of the connecting beam 20 is extended too much, the first swing output adjustment process is conducted in a step 88, so that the speed v1 for the inside crawler 2 may be decreased to retract the connecting beam 20, and then the process proceeds to a step S90. Furthermore, if the decisions in the step S87 is YES, i.e., if the length of the connecting beam 20 is retracted too much, the second swing output adjustment process is conducted in a step S89, so that the speed v2 for the outside crawler 2 may be decreased to extend the connecting beam 20, and then the process proceeds to the step S90. If both decisions in the steps of each S86 and S87 are NO, i.e., if the length L of the connecting beam 20 falls within the predetermined value ($L1 \geqq L \geqq L2$), the process proceeds to the step S90 as it is. In the step S90, a reference signal is sent to the auxiliary crane 1R, so that it may be propelled for swinging, and then the process for swinging terminates.

Now, in adjusting the output in the step S88 for the first swing output adjustment process or in the S89 for the second swing output adjustment process, the lengths L of the beam 20 detected by the beam length detecting means 53 at the previous time and the present time are compared, and then it is discriminated whether the adjustment operation is in the act of being carried out or not. If the adjustment is in practice, the beam length is held as it is. Furthermore, it is also possible to decide whether the adjustment of the beam length is being performed or not by means of the amount of the horizontal angle $\theta b$ detected by the beam angle detecting means 54, instead of the beam length detecting means 53.

On the one hand, if the decision is NO in the step S81, i.e., the auxiliary control unit 44 is selected, it is discriminated in a step S91 whether a swing reference signal is available from the main control unit 35 or not. This swing reference signal is for the auxiliary crane 1R in the step S90. If the decision is YES, the process for sending swing and propel signals based on the swing reference signals from the main control unit 35 to the crawler driving devices installed on the lower propelling body 3 of the auxiliary crane 1R is carried out in a step S92, and then the process for swinging terminates. On the other hand, if the decision is NO in the S91, the process for swinging terminates immediately.

The swing and propel control means 62 controls the swinging/propelling motion of the lower propelling body 3 of the auxiliary crane 1R whose swing unit 4 is locked, while the swing unit 4 stops propelling of the main crane 1L which is left free to rotate, and the length L of the connecting beam 20 is left adjustable within the predetermined range by means of the subroutine for processing for swinging, the main control unit 35 by which this control is executed, the auxiliary control unit 44 and the master control unit 55.

(Process of Propelling)

Figure 11:
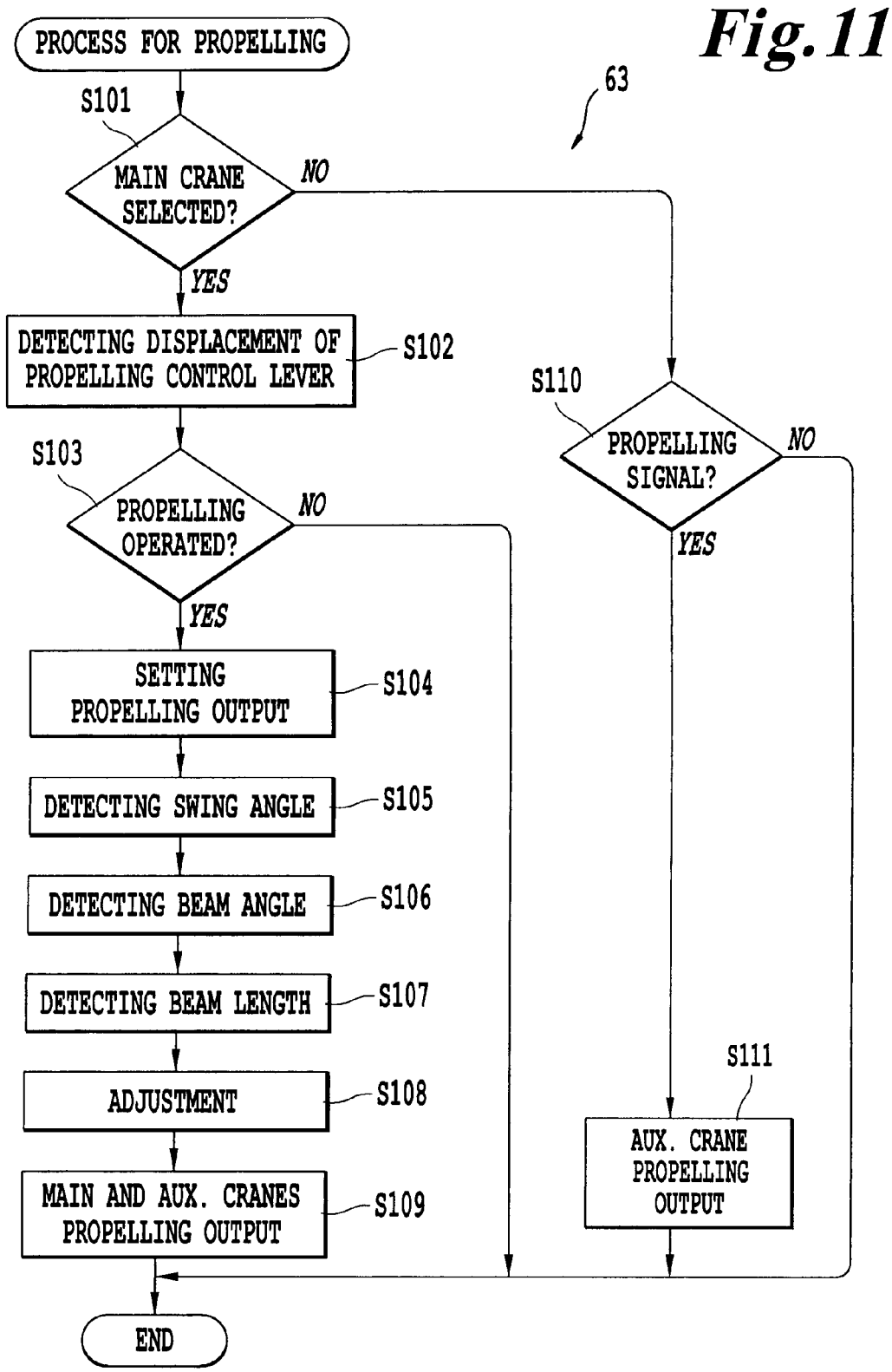
FIG. 11 is a flow chart showing a sub-routine to process propelling motion of the combination crane.

Said propelling step S15, according to the subroutine shown in FIG. 11, decides first of all in a step S101, which one is selected as the main and auxiliary cranes, the main crane 1L i.e. the main control unit 35 or not.

If the decision is YES, i.e., the main control unit 35 of the main crane 1L is decided, the amount of propelling is detected in a step S102 according to reference signals from various kinds of control displacement detecting means 33. In detail, the detecting means 33 is the means for detecting the displacement of propel control lever in propel forward or backward position. Then, in a step S103, it is decided whether propel operation has been carried out or not, based on the detected result. If the decision is YES, the process proceeds to a step S104. On the other hand, if the decision is NO, the process for propelling terminates immediately.

In the step S104, based on the amount of propel motion control, the process for setting propel output is carried out. Consequently, based on the signals from the swing angle detecting means 34, the process for detecting the swing angle θa of the upper body of the main crane 1L is carried out in a step S105. Based on the signals from the beam angle detecting means 54, the process for detecting the horizontal beam angle θb of the connecting beam 20 is carried out in a step S106. Based on the signals from the beam length detecting means 53, the process for detecting the length L of the connecting beam 20 is carried out in a step S107, respectively. Then, those setting values previously set at the step S104 should be readjusted in a step S108 according to said respective swing angle θa, horizontal beam angle θb of the connecting beam 20 and connecting beam length L so that the main crane 1L and auxiliary crane 1R may move in parallel. And then, based on a setting value (output value) after being readjusted, the output setting signal to the main 1L and the auxiliary 1R cranes is processed in a step in S109, and then the propel processing is terminated.

In said step S101 on the contrary, if the decision is NO i.e., the auxiliary control unit 44 is selected, in a step S110, it is decided whether a propel reference signal is available from the main control unit 35 or not. The propel reference signal means a propel output signal for the auxiliary crane 1R in a step S109. If the decision is YES, the process for setting propel output is carried out in a step S111 based on the propel reference signal from the main control unit 35 to the auxiliary crane 1R, and then the processing for the propelling motion terminates. If the decision is NO, processing for the propelling motion terminates immediately.

A parallel propelling means 63 controls both cranes 1L and 1R to propel in parallel by means of the subroutine of aforementioned propelling processing, the main control unit 35, the auxiliary control unit 44 and the master control unit 55.

Following the above, FIGS. 12 to 14 show how to set the propel output in the step S104 and the step S108 during the aforementioned propelling process to control the parallel propelling. Specifically, when the combination crane A is propelling, the main crane 1L and the auxiliary crane 1R are parallel propelling (i.e. the swing angle of the main crane 1L is θa=0°), and at the same time, the auxiliary crane 1R is heading straight forward (i.e., the connecting beam angle is θb=90°) as illustrated in FIG. 12 (*a*), the crawler speeds for each crane 1L and 1R are set at the same speed vp. As shown in FIG. 12 (*b*), with both main crane 1L and auxiliary crane 1R in a row position, when the auxiliary crane is heading outward (i.e., the horizontal angle θb>90°), the propel speeds of the crawlers on both sides of the main crane 1L and the one on the right side (outside) of the auxiliary crane 1R are set at vp, while only the speed of the left side of the crawler (inside) of the auxiliary crane 1R is set at vp−α (α is constant) that is slower than vp. As shown in FIG. 12 (*c*), both main crane 1L and auxiliary crane 1R in a row, when the auxiliary crane 1R is heading inward (i.e., the horizontal beam angle θb<90°), the propel speeds of the crawlers on both sides of the main crane 1L and the one on left side (inside) of the auxiliary crane 1R are set at vp, while only the speed of the right side (outside) of the crawler of the auxiliary crane 1R is set at vp−α that is slower than vp.

Further, as shown in FIG. 13 (*a*), when the auxiliary crane 1R is in an anterior position to the main crane 1L (i.e., the swing angle of the main crane 1L θa is in the left swing), and when the auxiliary crane 1R is also in a position heading straight forward (i.e., θa+90°=θb), the speeds of both right and left crawlers of the main crane 1L are set at vp, and that of both right and left crawlers of the auxiliary crane 1R is set at vp−α respectively. As shown in FIG. 13 (*b*), when the auxiliary crane 1R is in the anterior position to the main crane 1L, and when the auxiliary crane 1R is also in a position heading inward (i.e., θa+90°>θb), the speeds of both right and left crawlers of the main crane are set at vp, and that of the left crawler of the auxiliary crane 1R is set at vp−α, and that of the right crawler of the auxiliary crane 1R is set at vp−α−β (β is constant) respectively. As shown in FIG. 13 (*c*), when the auxiliary crane 1R is in the anterior position to the main crane 1L, and when the auxiliary crane 1R is also in a position heading outward (i.e., θa+90°<θb), the speeds of both right and left crawlers of the main crane 1L are set at vp, and that of the left crawler of the auxiliary crane 1R is set at vp−α−β, and that of the right crawler of the auxiliary crane 1R is set at vp−α respectively.

In addition, as shown in FIG. 14 (*a*), when the main crane 1L is in the anterior position to the auxiliary crane 1R (i.e., the swing angle of the main crane 1L θa is in right swing), and when the auxiliary crane 1R is in a position heading straight forward (i.e., 90°−θa=θb), the speeds of both right and left crawlers of the main crane 1L are set at vp−α, and those of both right and left crawlers of the auxiliary crane 1R are set at vp respectively. As shown in FIG. 14 (*b*), when the main crane 1L is in the anterior position to the auxiliary crane 1R, and when the auxiliary crane 1R is in a position heading outward (i.e., 90°−θa<θb), the speeds of both right and left crawlers of the main crane 1L are set at vp−α, and that of the left crawler of the auxiliary crane 1R is set at vp−β, and that of the right crawler of the auxiliary crane 1R is set at vp respectively. As shown in FIG. 14 (*c*), when the main crane 1L is in the anterior position to the auxiliary crane 1R, and when the auxiliary crane 1R is in a position heading inward (i.e., 90°−θa>θb), the speeds of both right and left crawlers of the main crane 1L are set at vp−α, and that of the left crawler of the auxiliary crane 1R is set at vp, and that of the right crawler of the auxiliary crane 1R is set at vp−β respectively.

Accordingly, said combination crane A is prepared in a condition that the swing unit 4 of the main crane 1L is set free to rotate and the swing unit 4 of the auxiliary crane 1R is placed in a locked position beforehand. With this condition fulfilled, keeping the main crane 1L stopped and holding within the predetermined range the telescopic length L of the connecting beam 20 that combines the main crane 1L with the auxiliary crane 1R, the lower propelling body 3 of the auxiliary crane 1R is made to travel to swing so as to allow said combination crane A to start to perform a swing motion. Therefore, without giving any hindrances to crane works, like using one large crawler crane, said combination crane A exercises its capability that doubles the basic lifting capacity of each main crane 1L and auxiliary crane 1R effectively.

Furthermore, the beam 20 is not only designed telescopic to adjust its length L within the predetermined range, but also installed on the horizontal shaft 24 on the upper revolving body 5 of the main crane 1L and pivotally installed on both horizontal shaft 25 and vertical shaft 26 on the upper revolving body 5 of the auxiliary crane 1R in away to turn around on each shaft. Therefore, when said combination crane A is in a swing motion, if the auxiliary crane 1R runs out of the predetermined orbit, the connecting beam 20 makes telescopic motion. Moreover, while it is in a swing motion, if the auxiliary crane 1R runs out of the tangential line of the predetermined orbit, the connecting beam 20 pivotally turns on the vertical shaft 26 against the auxiliary crane 1R. In addition, while in the swing motion, if the main crane 1L and the auxiliary crane 1R come to locate on a different ground level caused by some particular ground conditions like inclined grounds, the connecting beam 20 pivotally turns on the horizontal shafts 25 and 24 respectively against each main crane 1L and auxiliary crane 1R. Because of these functions, the connecting beam 20 and those connecting portions of the main crane 1L and the auxiliary crane 1R where the connecting beam 20 is installed are free from excessive bending moment, compression and tension stresses. Therefore, the connecting beam 20 is protected from any possible damages.

Moreover, the construction of said combination crane A is simple enough to comprise the upper swing bodies 5 of two crawler cranes 1L, 1R and the telescopic connecting beam 20 that combines two swing bodies. Because of this simplicity, the present invention is easily embodied. In addition, as the cranes 1L and 1R can be separated to work as a single crane individually, so the operation of the field will become very efficient without any additional costs and working space.

Especially, in case of the embodiment of the present invention, when said combination crane A is in a swing motion, the lower propelling body of the auxiliary crane 1R is controlled by the master control unit 55 that receives signals from the beam length detecting means 53 for detecting the length L of the beam 20. Therefore, allowing the connecting beam 20 to make an axial telescopic motion to keep its length L within the predetermined range, the swing motion is easily and securely achieved, and the operability of the swing motion can be improved.

Next, as the master control unit 55 totally controls both main crane 1L and auxiliary crane 1R for each process of hoisting/lowering, boom hoisting/lowering and propelling. Therefore, all the processes can be done safely. In other words, in case of hoisting and lowering, the hoist mechanisms of each main crane 1L and auxiliary crane 1R are totally controlled, so that the lifting beam 27 may be kept in a horizontal position by adjusting the difference in rope tension $\Delta f$ within the predetermined range. Accordingly, the load from a lifting material W is equally applied to both main crane 1 L and auxiliary crane 1R, and consequently the stability of hoisting and lowering works is secured. In case of boom raising and lowering, as tilting mechanisms 10 of both main crane 1L and auxiliary crane 1R are totally controlled, so that the difference in the angles of the booms 6 of each main crane 1L and auxiliary crane 1R may be kept within the predetermined range. Therefore, the booms 6 of both main crane 1L and auxiliary crane 1R are raised or lowered synchronously, and thus the stability and safety of lifting jobs with horizontal movement assisted by tilting actions of the booms are secured. In addition, in case of propelling, as the lower propelling bodies 3 of both main crane 1L and auxiliary crane 1R are totally controlled without being disturbed, and consequently the stability of parallel propelling can be secured.

Figure 15:
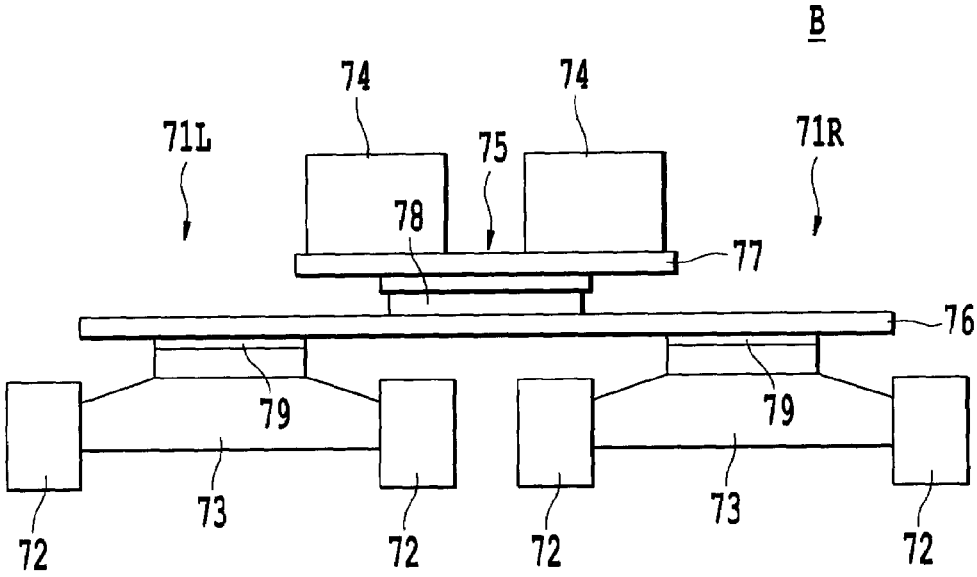
FIG. 15 is a schematic view showing the second embodiment of the present invention.

FIG. 15 shows the second embodiment of the present invention in reference to a combination crane B. Said combination crane B works as one crane by combining two crawler cranes 71L and 71R that are of the identical model and performances each other. The crawler cranes 71L and 71R can work as a single crane independently.

Each crawler crane 71L and 71R is provided with a lower propelling body 73 supported by crawler frames 72, 72 on each side of the lower propelling body, and also provided with an upper revolving body 74. Furthermore, although not shown in the drawing, like the combination crane A of the first embodiment, the upper revolving bodies 74 are provided with at least booms whose base sections are supported in a tiltable way, tilting mechanisms which hoist and lower the booms, hoist mechanisms which hoist and lower lifting materials which are hung from top of the booms by hoist wire ropes, and an operator cab.

The lower propelling bodies 73 and 73 of said two crawler cranes 71L and 71R are positioned in parallel and next to each other. A deck frame 75 is bridged over the lower propelling bodies 73 in a transverse direction. The deck frame 75 accommodates a swing unit 78 between a lower part 76 and an upper part 77. Between the lower part 76 of the deck frame 75 and each lower propelling body 73, an elastic structure 79 is installed, so that it may absorb the differences of height and level between the lower propelling bodies 73 and 73 of the crawler cranes 71L and 71R. The elastic structure 79 is made of elastic rubber material for example. The upper swing bodies 74 of said crawler cranes 71L and 71R are mounted in a row on the upper part 77 of the deck frame 75.

Accordingly, in the above combination crane B, the lower part 76 of the deck frame 75 that accommodates the swing unit 78 between the upper part 77 and the lower part 76 is bridged over the lower propelling bodies 73 and 73 of the crawler cranes 71L and 71R. On the upper part 77 of the deck frame 75, the upper revolving bodies 74 and 74 of two crawler cranes 71L and 71R are mounted in parallel. Therefore, it is possible for the swing unit 78 of the deck frame 75 to swing the upper revolving bodies 74 of the combination crane B. As a result, similarly to a large crane, without giving any hindrances to crane works in the field, said combination crane B doubles the basic lifting capacity of each crane 71L and 71R effectively. In addition, the same control systems as used on the first embodiment can be applied to said combination crane B except for processing for swing motion. As for the swing control system, the same one as used on the crawler crane can be used.

Figure 16:
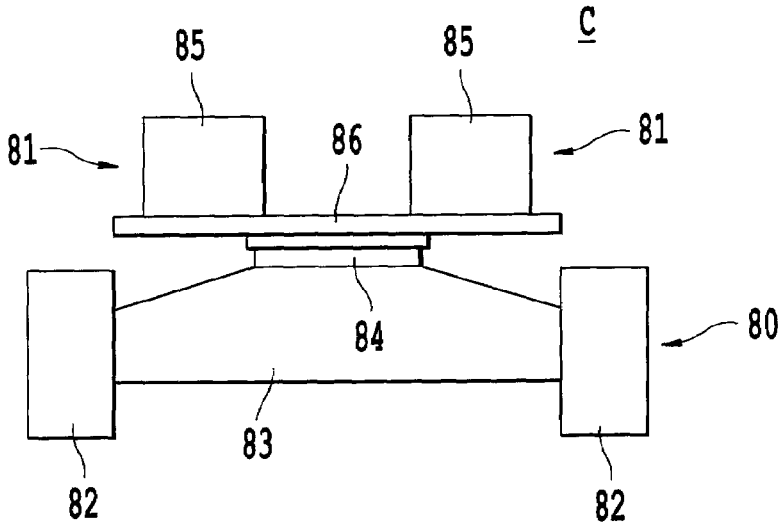
FIG. 16 is a schematic view showing the third embodiment of the present invention.

FIG. 16 shows the third embodiment of the present invention in reference to a combination crane C. Said combination crane C comprises one large crawler crane 80 and two smaller crawler cranes 81 and 82 whose lifting capacity is smaller than that of the large crane.

Said crawler crane 80 is provided with the lower propelling body 83 supported by crawler frames 82, 82 on each side of the lower propelling body 83, and it is provided with an upper revolving bodies 85, 85 that are rotatably installed on the lower propelling body 83 accommodating a swing unit 84 between the upper revolving bodies 85, 85 and the lower propelling body 83. Although not shown in the drawing, like the combination crane A of the first embodiment, each of the upper revolving bodies 85, 85 is provided with at least a boom whose base section is tiltably supported on the respective upper revolving body 85, tilting mechanism that hoists and lowers the boom, hoist mechanism that hoists and lowers lifting materials which is hung from the top of the boom by hoist wire ropes, and an operator cab. In case of the present embodiment, a revolving deck frame 86 rotatably mounted on the lower propelling body 83 of the large crawler crane 80 through the swing unit 84. The upper revolving bodies 85 and 85 of the small cranes are installed in a row on the revolving deck frame 86.

Accordingly, as for said combination crane C, the revolving deck frame 86 is installed on the lower propelling body 83 of the large crawler crane 80 through the swing unit 84, and on the upper revolving deck frame 86, the upper revolving bodies 85 and 85 of the small crawler cranes 81 and 81 are installed in a row in a transverse direction. Therefore, changing the direction of both upper revolving bodies 85 and 85 is done by means of the swing unit 84. Accordingly, similarly to a large crane, without giving any hindrances to crane works in the field, said combination crane C doubles the lifting capacity of each small crane. In addition, as for the swing and propel control systems for said combination crane C, the same control systems as used on a single crawler crane can be used.

Further, it should be noted that the present invention is not limited to the above first to the third embodiments, but includes a variety of other embodiments. For example, in the first embodiment, although all the processes in the combined mode are composed of automatic control systems, but in the present invention, a part of the processes in the combined mode i.e., the process for propelling for example, may be changed to manual control. Furthermore, in the present invention, all the processes in the combined mode can be composed of manual control.

Moreover, as for the abovementioned first embodiment, the main control unit 35 that controls various actuators 36 of the main crane 1L, the auxiliary control unit 44 that controls various actuators 45 of the auxiliary crane 1R and the master control unit 55 that totally controls both control units 35 and 44 are provided in the control system of the combination crane A. Instead of using these control units, it may be possible to introduce a single control unit that comprises the main control unit 35 and the master control unit 55 in the present invention. In addition, it may be also possible to introduce another control unit that composes the above three kinds of control units 35, 45, 55 as a single unit.

Furthermore, three factors are used in the above first embodiment in order to control the parallel propelling of the main crane 1L and the auxiliary crane 1R. These three factors are the swing angle θa of the upper revolving body 5 of the main crane 1L measured by the swing angle detecting means 34, the horizontal angle θb of the beam 20 measured by the beam angle detecting means 54 and the beam length L measured by the beam length detecting means 53. However, in the present invention, it may be also possible to use only two factors; they are the swing angle θa of the upper revolving body 5 of the main crane 1L measured by the swing angle detecting means 34 and either the horizontal angle θb of the beam 20 measured by the beam angle detecting means 54 or the beam length L measured by the beam length detecting means 53.

In addition, two crawler cranes 1L and 1R are discussed in the above first embodiment as a crane with lattice type boom, however, the present invention is equally applicable to a crane with a telescopic type boom in lieu of the lattice type boom 6.

We claim:

1. A combination crane used for crane operation, comprising:

two crawler cranes, each of said crawler cranes respectively comprising a lower propelling body having crawlers, an upper revolving body rotatably mounted on said lower propelling body, a boom whose base section is tiltably supported on said upper revolving body, a tilting mechanism that hoists and lowers said boom, and a hoist mechanism that hoists and lowers a lifting member hung by a hoist rope from a top of said boom;

a connecting beam which connects said upper revolving bodies of said two crawler cranes; and means for controlling swinging and propelling of said combination crane by stopping the crawlers of the lower propelling body of one of said two crawler cranes, unlocking the upper revolving body of the one of said two crawler cranes such that the upper revolving body of the one of said two crawler cranes can rotate relative to the lower revolving body of the one of said two crawler cranes, locking the upper revolving body of the other of said two crawler cranes such that the upper revolving body of the other of said two crawler cranes cannot rotate relative to the lower revolving body of the other of said two crawler cranes, and operating the crawlers of the lower propelling body of the other of said two crawler cranes such that the other of the two crawler cranes swings around the one of the two crawler cranes, wherein said connecting beam is rotatably connected to both of said upper revolving bodies of said two crawler cranes so as to rotate around an approximately horizontal axis.

2. The combination crane according to claim 1, wherein said connecting beam is rotatably connected to said upper revolving body of said other of said two crawler cranes so as to rotate around an approximately vertical axis.

3. The combination crane according to claim 1, wherein said connecting beam is able to allow telescopic movement along an axial direction of said connecting beam.

4. The combination crane according to claim 1, wherein said connecting beam is rotatably connected to said upper revolving body of said other of said two crawler cranes so as to rotate around an approximately vertical axis, and said connecting beam is able to allow telescopic movement along an axial direction of said connecting beam.

5. The combination crane according to claim 4, further comprising:

a load detecting means for detecting a load of a lifting material suspended by lifting members, said load detecting means respectively provided on both of said crawler cranes; and a master hoisting control means for controlling said hoist mechanisms of said crawler cranes so as to keep a difference of said loads respectively detected by said load detecting means of said crawler cranes within a predetermined range, said master hoisting control means receiving signals from said load detecting means.

6. The combination crane according to claim 4, further comprising:

a boom angle detecting means for detecting a boom angle, said boom angle detecting means respectively provided on both of said crawler cranes; and a master tilting control means for controlling said tilting mechanisms of said crawler cranes so as to keep a difference of said angles respectively detected by said boom angle detecting means of said crawler cranes within a predetermined range, said master tilting control means receiving signals from said boom angle detecting means.

7. The combination crane according to claim 4, further comprising:

a beam angle detecting means for detecting a beam angle of said connecting beam around said approximately vertical axis;

a swing angle detecting means for detecting a swing angle of said upper revolving body of said one of said crawler cranes; and a parallel propelling means for controlling both of said crawler cranes to propel in parallel, basing on angles detected by said beam angle detecting means and said swing angle detecting means.

8. The combination crane according to claim 4, further comprising:

a beam length detecting means for detecting a length of said connecting beam;

a swing angle detecting means for detecting a swing angle of said upper revolving body of said one of said crawler cranes; and a parallel propelling means for controlling both of said crawler cranes to propel in parallel, basing on a swing angle detected by said swing angle detecting means and a length detected by said beam length detecting means.

9. The combination crane according to claim 4, further comprising a beam length detecting means for detecting a length of said connecting beam, wherein said means for controlling swinging and propelling of said combination crane operates the crawlers of the lower propelling body of the other of said two crawler cranes based on a length of said connecting beam detected by said beam length detecting means.

10. The combination crane according to claim 9, further comprising a beam angle detecting means which detects a swing angle of said connecting beam around said approximately vertical axis.

11. The combination crane according to claim 10, wherein said means for controlling swinging and propelling of said combination crane controls said lower propelling body of at least one of said two crawler cranes based on a beam angle detected by said beam angle detecting means.

* * * * *